US005536624A

United States Patent [19]

Nishinoiri et al.

[11] Patent Number: 5,536,624

[45] Date of Patent: Jul. 16, 1996

[54] SILVER HALIDE PHOTOGRAPHIC PHOTOSENSITIVE MATERIAL

[75] Inventors: Hiroshi Nishinoiri; Masao Okushima, both of Tokyo, Japan

[73] Assignee: Mitsubishi Paper Mills, Ltd., Tokyo, Japan

[21] Appl. No.: 399,885

[22] Filed: Mar. 7, 1995

[30] Foreign Application Priority Data

Jun. 2, 1994 [JP] Japan ..... 6-121062

[51] Int. Cl.[6] ..... G03C 1/10; G03C 1/12; G03C 5/29; G03C 5/08; G03C 7/46

[52] U.S. Cl. ..... 430/356; 430/571; 430/396; 430/503

[58] Field of Search ..... 430/571, 503, 430/356

[56] References Cited

U.S. PATENT DOCUMENTS

| | | | |
|---|---|---|---|
| 2,384,598 | 9/1945 | Carroll | 430/571 |
| 2,388,859 | 11/1945 | Mannes et al. | 430/571 |
| 3,628,960 | 12/1971 | Philippaerts et al. | 430/571 |
| 4,175,967 | 11/1979 | Krause | 430/503 |
| 4,230,795 | 10/1980 | Krause | 430/503 |
| 4,987,063 | 1/1991 | Kampfer et al. | 430/571 |
| 5,084,374 | 1/1992 | Waki et al. | 430/504 |
| 5,126,237 | 6/1992 | Okumura et al. | 430/571 |

FOREIGN PATENT DOCUMENTS

| | | |
|---|---|---|
| 33-6444 | 8/1958 | Japan . |
| 62-215954 | 9/1987 | Japan . |
| 1-167745 | 7/1989 | Japan . |
| 3240049 | 1/1990 | Japan . |
| 4-6550 | 1/1992 | Japan . |
| 4-324441 | 11/1992 | Japan . |
| 4-321026 | 11/1992 | Japan . |

OTHER PUBLICATIONS

Yoshinaga, "Handbook of Applied Spectroscopy", 1973, p. 270.

Kubota et al., "Handbook of Optical Technique", 1968) p. 424–433.

*Primary Examiner*—Richard L. Schilling

*Attorney, Agent, or Firm*—Cushman Darby & Cushman

[57] ABSTRACT

The present invention provides a silver halide photographic photosensitive material which has a printability from color negatives and which can be used as a variable contrast printing paper. This silver halide photographic photosensitive material comprises a support and at least one silver halide emulsion layer provided on the support wherein when γ (gamma) values of characteristic curves obtained by exposure through filters having a transmission maximum wavelength at about 430 nm, about 540 nm and about 700 nm are indicated by $\gamma_B$, $\gamma_G$ and $\gamma_R$, respectively, the following inequalities $0.3<\gamma_G/\gamma_B<0.7$ and $0.3<\gamma_G/\gamma_R<1.0$ are satisfied. Furthermore, an exposing method is also provided.

2 Claims, No Drawings

SILVER HALIDE PHOTOGRAPHIC PHOTOSENSITIVE MATERIAL

BACKGROUND OF THE INVENTION

The present invention relates to a silver halide photographic photosensitive material which has a printability from color negative films and furthermore, which is usable as a variable contrast paper for at least black and white negative films using tone varying filters adjusted by selecting wavelengths which transmit therethrough and to a printing process using the photosensitive material. The present invention further relates to a photographic photosensitive material usable as a variable contrast paper not only for black and white negative films, but also for color negative films using tone varying filters adjusted by selecting wavelengths which transmit therethrough.

In general, as black and white printing papers, those which differ in grade of contrast from No.1 to No.5 depending on the contrast of the black and white negative films to be contact-printed or enlargement-printed are separately assorted and marketed. However, in order to obtain optimum prints depending on various negatives, users must manufacture printing papers of many kinds of grades in contrast, and if frequency in use of them is small, the quality of them may change in storage. For solving this problem, the variable contrast printing paper is known from which prints differing in contrast can be obtained with one printing paper by adjusting the exposure wavelengths by selecting optical filters differing in wavelength which they can transmit (tone varying filters).

Recently, there are many chances to take color photographs and in many cases, we use only one camera loaded with a color film. In this case, the demand increases that not only color prints, but also black and white prints can be obtained from the photographed color films. However, when printed on the conventional No.1–No.5 contrast printing papers or variable contrast printing papers, no prints having satisfactory quality in contrast have been able to be obtained. Therefore, black and white printing papers have been desired on which black and white printing of excellent quality can be performed from color negative films with one photosensitive material and furthermore, by which a high finishing quality from black and white negative can be obtained.

For printing of color negatives on black and white printing papers, so-called panchromatic black and white printing papers having sensitivity to blue, green and red are generally used. This is because, being different from black and white negatives, the color negatives comprise three dye images of Y, M and C and the printing papers must have sensitive portions for the whole wavelength regions of visible light in order to obtain the higher fidelity tone reproduction and excellent graininess and sharpness. Furthermore, when handleability under the lighter safelight is required, orthochromatic photosensitive materials are sometimes used, but for lack of red sensitivity, the materials are inferior in color reproducibility and graininess.

Moreover, as for the tone reproduction, in the case of color films like the black and white films, negatives of from low contrast to high contrast characteristics are produced depending on the conditions at the time of photographing and besides, the tone differs depending on the kind of the color films even if correct exposure is conducted. Therefore, in order to obtain finally satisfactory positive prints, it is not enough for color films only to have panchromatic color sensitivity and it is necessary to assort printing papers differing in contrast from low contrast to high contrast. Thus, the manufacturers sell panchromatic black and white printing papers shown by tone numbers.

The manner of use of panchromatic black and white printing papers can be roughly classified into manual printing by an enlarger in a dark room and printing under roomlight by a printer united with a processor. In the case of the manual printing, for obtaining good prints, printing papers of optimum tone number are selected and used according to the tone of the negatives among a plurality of printing papers differing in contrast. Accordingly, there are problems that the number of expired printing papers increases due to increase in stock or decrease in frequency in use. Furthermore, in order to obtain satisfactory prints when printing is carried out by a printer united with a processor, the printing paper must be changed depending on the tone of the color negative, but since this causes reduction of working efficiency, actually the printing is carried out with one printing paper and at present, no measure is taken for adaptation to the tone of the negative. As a measure, there is a process of printing by auxiliary exposure, but from the point of characteristics, only the tone of tip of toe of characteristic curve is controlled and with increase of the auxiliary exposure, the characteristic curve is extended and curved in the tip of toe and this does not mean ideal characteristics and besides, this causes increase of fog and fluctuation of sensitivity. Thus, the conventional panchromatic black and white printing papers are not necessarily satisfactory for users.

SUMMARY OF THE INVENTION

An object of the present invention is to provide a panchromatic black and white printing paper which maintains performances as a variable contrast paper wide in width of contrast variability and high in finished quality by using commercially available tone varying filters for black and white negative films and furthermore, which can also give black and white prints having satisfactory contrast in printing from color films (hereinafter referred to as "variable contrast printing paper having adaptability to color negative").

Another object of the present invention is to provide a method of exposure which does not damage the width of contrast variability in printing a black and white negative using the above-mentioned printing paper.

Further another object of the present invention is to provide a silver halide photographic photosensitive material which has excellent color sensitivity, graininess and sharpness and which can vary in contrast not only for black and white negative film, but also for color negative film by using in combination tone varying filters designed so as to adapt to the printing paper (hereinafter referred to as "variable contrast printing paper for both color negative and black and white negative").

The object of the present invention has been attained by a silver halide photographic photosensitive material comprising a support and at least one silver halide emulsion layer provided on the support, characterized in that when $\gamma$ (gamma) values of characteristic curves obtained by exposure through filters having a transmission maximum at about 430 nm, about 540 nm and about 700 nm are indicated by $\gamma_B$, $\gamma_G$ and $\gamma_R$, respectively, these satisfy the following inequalities $0.3<\gamma_G/\gamma_B<0.7$ and $0.3<\gamma_G/\gamma_R<1.0$.

$\gamma_B$ shows a gradient of a characteristic curve of from a reflection density of 0.02 to a density of 90% of the maximum reflection density of a sample which is subjected to sensitometric exposure through an optical filter (such as Kodak Wratten filter 47B) having a transmission maximum at about 430 nm, developed with D- 72 developer (manufactured by Kodak Co.) at 20° C. for 90 seconds and subjected to fixation. $\gamma_G$ and $\gamma_R$ are obtained in the same manner as $\gamma_B$ except that an optical filter (such as Kodak Wratten filter 74) having a transmission maximum at about 540 nm is used for $\gamma_G$ and an optical filter (such as Kodak Wratten filter 70) having a transmission maximum at about 700 nm is used for $\gamma_R$. Here, about 430 nm, about 540 nm and about 700 nm mean that the transmission maxima can be about 430 nm±about 5 nm, about 540 nm±about 5 nm and about 700 nm±about 5 nm, respectively.

Another object of the present invention has been attained by a method of exposure of the silver halide photographic photosensitive material of the present invention which comprises carrying out the printing in such a manner as varying in contrast from a black and white negative using tone varying filters for commercially available variable contrast printing papers, characterized by using in combination commercially available tone varying filters and a C filter designed to have a transmittance of 80% or more for a light of 400–525 nm in wavelength, a transmittance of 10% or less for a light of 620–750 nm in wavelength and a point at which the transmittance for a light in a wavelength region of 570±45 nm is 50%.

Further another object of the present invention has been attained by a black and white photographic photosensitive material comprising a support and one silver halide emulsion layer provided on the support, characterized in that the silver halide emulsion comprises two or more components differing in spectral sensitivity in the sensitive wavelength regions of 400–500 nm, 500–600 nm and 600 nm or longer, respectively and the photosensitive material is designed so that different tones can be obtained by selecting exposure wavelength within the wavelength regions mentioned above.

DESCRIPTION OF THE INVENTION

First, the variable contrast printing paper of the present invention which has an adaptability to color negatives will be explained.

In order to obtain a variable contrast paper used for printing through a black and white negative, it is necessary that one emulsion layer containing at least two kinds of silver halides having different spectral sensitivities or at least two emulsion layers containing these silver halides separately are coated on a support. The variable contrast printing paper can be produced by the methods described, for example, in Japanese Patent Kokai (Laid-Open) Nos.62-215943, 4-6550, 4-321026 and 4- 324441.

For example, a combination of a silver halide emulsion A (high contrast component A) having a spectral sensitivity in only the region of 400–480 nm and a silver halide emulsion B (low contrast component B) having a spectral sensitivity in only the region of 500–580 nm is often employed, whereby variable contrast printing papers having relatively superior characteristics can be obtained. In addition, further superior variable contrast printing papers can be obtained when the low contrast component B having a spectral sensitivity in the region of 500–580 nm comprises a plurality of components differing in adsorption amount of sensitizing dye per unit area of the silver halide, namely, differing in sensitivity as described in Japanese Patent Kokai (Laid-Open) No.4-6550. Furthermore, a plurality of silver halide components differing in spectral sensitivity and contrast can be contained in one layer and besides, a plurality of silver halide components differing in spectral sensitivity and contrast can be contained in separate multiple layers, respectively.

On the other hand, in order to obtain adaptability to printing from a color negative, it is necessary for the emulsion to have spectral sensitivities corresponding to optical components obtained through an image comprising the dyes of Y, M, C produced in the color negative, namely, it is necessary that the silver halide emulsion is spectrally sensitized so that it can adapt to the respective wavelength regions of 400–500 nm, 500–600 nm and 600–750 nm.

Under the circumstances, the inventors have conducted intensive research and found that the object of the present invention to provide satisfactory tone obtained by printing with a color negative without damaging the variable contrast characteristics has been attained by a silver halide photographic photosensitive material which is adjusted in its photographic characteristics so as to satisfy the relations $0.3<\gamma_G/\gamma_B<0.7$ and $0.3<\gamma_G/\gamma_R<1.0$ when $\gamma$ (gamma) values of characteristic curves obtained by exposure through filters having a transmission maximum at about 430 nm, about 540 nm and about 700 nm are indicated by $\gamma_B$, $\gamma_G$ and $\gamma_R$, respectively.

As the sensitizing dyes which spectrally sensitize the region of 500–580 nm and are used for constituting the low contrast component B of the present invention, there may be used those which are described in Japanese Patent Kokai (Laid-Open) Nos.4-6550 and 4- 324441. Especially preferred are those which are represented by the following formula (1):

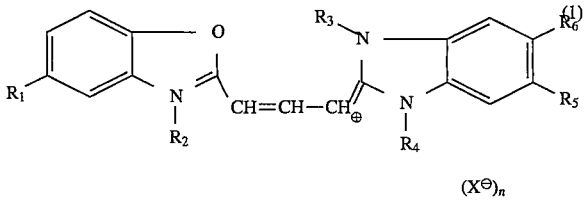

wherein $R_1$ represents a hydrogen atom, a halogen atom, an alkyl group, an alkoxy group or an aryl group, $R_2$ represents an alkyl group, a sulfoalkyl group or a carboxyalkyl group, $R_3$ represents an alkyl group, a hydroxyalkyl group or an acyloxyalkyl group, $R_4$ represents an alkyl group, a sulfoalkyl group or a carboxyalkyl group, $R_5$ and $R_6$ each represent a hydrogen atom, a halogen atom, a cyano group, an aminocarbonyl group, a trifluoromethyl group, an alkoxycarbonyl group or a morpholinosulfonyl group, $X^-$ represents an anion, and n represents 0 or 1, with a proviso that n represents 0 when one of the groups represented by $R_2$ or $R_4$ is a sulfoalkyl group or a carboxyalkyl group and n represents 1 when both of the groups represented by $R_2$ and $R_4$ are not sulfoalkyl group or carboxyalkyl group.

In the formula (1), the alkyl, sulfoalkyl, carboxyalkyl, hydroxyalkyl and acyloxyalkyl groups are especially preferably those which have 1–6 carbon atoms in the alkyl group thereof. The term "acyl" preferably represents a $C_1$–$C_4$ alkylcarbonyl group. The halogen atom is preferably chlorine atom. The alkoxy and alkoxycarbonyl groups can have 1–4 carbon atoms in the alkoxy portion.

The anion may be a chloride or bromide ion, a sulfate ion, or an alkylsulfate ion such as a methylsulfate ion or an ethylsulfate ion. It may further be a perchlorate ion or a p-toluenesulfonate ion.

Nonlimiting typical examples of the sensitizing dyes represented by the formula (1) are shown below.

(1)-1
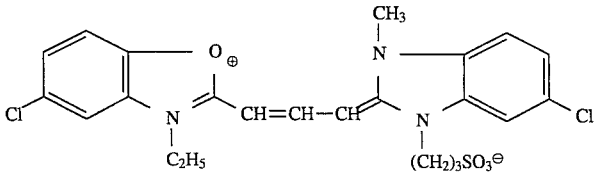
(1)-2
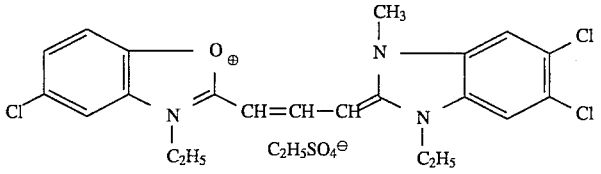
(1)-3
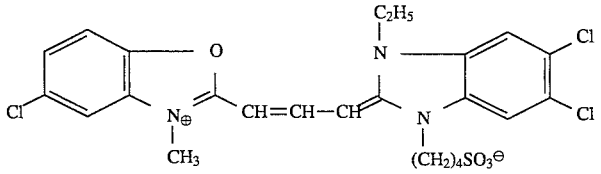
(1)-4
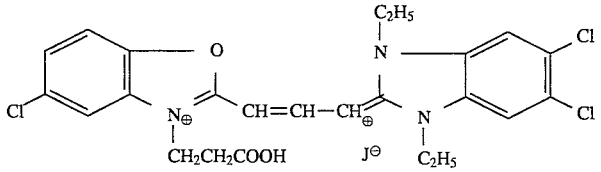
(1)-5
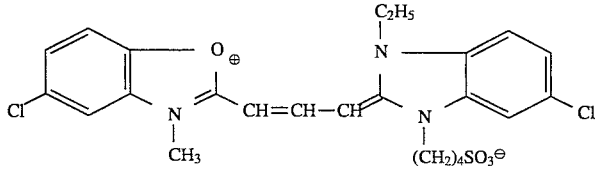
(1)-6
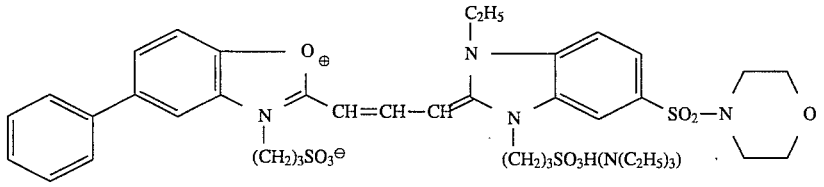
(1)-7
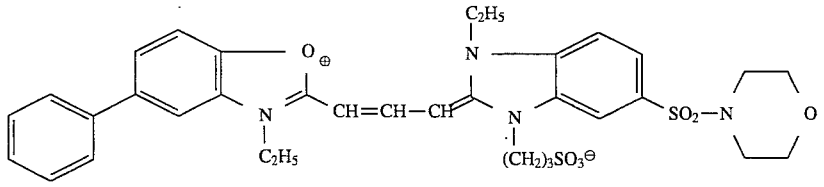
(1)-8
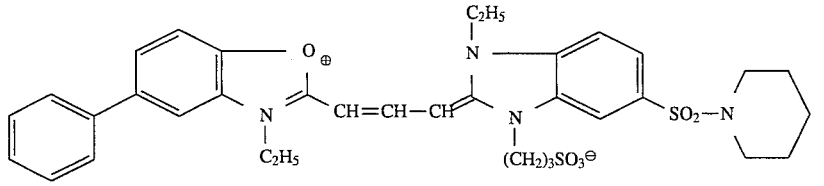
(1)-9
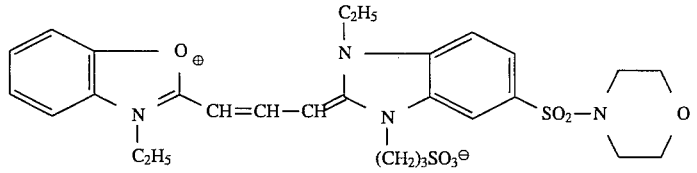

-continued

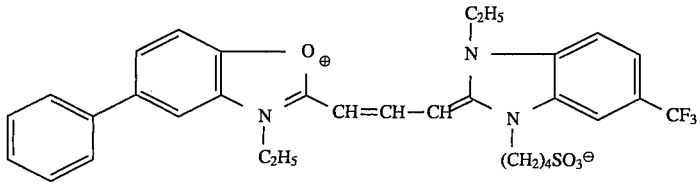

(1)-10

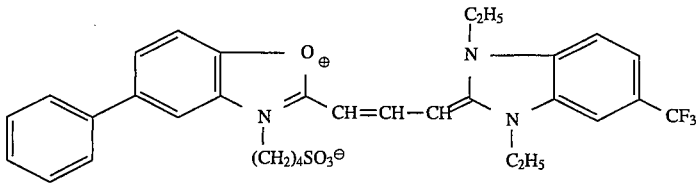

(1)-11

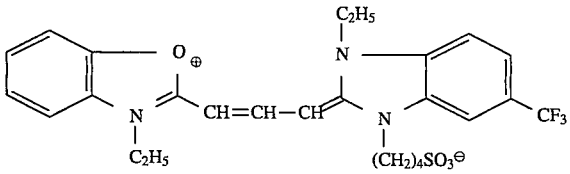

(1)-12

The sensitizing dye used here is preferably added in the form of a solution in water or a water-miscible organic solvent such as methanol, ethanol, methyl cellosolve or the like to the silver halide emulsion and adsorbed thereto. Besides, it can be added to the emulsion in the form of a dispersion by dissolving it in a water-insoluble solvent. Amount of the sensitizing dye varies depending on the kind of the dye or emulsion, but usually an optimum amount can be optionally selected from the range of $10^{-6}$–$10^{-2}$ mol, preferably $10^{-5}$–$10^{-3}$ mol for 1 mol of the silver halide. Moreover, as described in Japanese Patent Kokai (Laid-Open) No.4-6550, especially preferably the silver halide emulsion is divided to about 2–4 portions in different amounts and the sensitizing dye is added to each of them with changing the adsorption amount of the dye per unit area of the silver halide.

The silver halide emulsion A (high contrast component A) having the sensitivity maximum at 480 nm or shorter may not contain sensitizing dyes or may be sensitized to about 480 nm by adding the sensitizing dyes described in Japanese Patent Kokai (Laid-Open) No.1-167745. The sensitizing dye for shorter than 480 nm may be added to one of the emulsions A and B or may be added to the mixture of the emulsions A and B.

The $\gamma_B$ of the high contrast component A and the $\gamma_G$ of the low contrast component B are adjusted so as to satisfy the above-mentioned relation $0.3<\gamma_G/\gamma_B<0.7$ considering the influence of various conditions for mixing the silver halide emulsions such as kind and amount of the sensitizing dyes, method of addition and mixing ratio of the emulsions and furthermore, kind and amount of the sensitizing dyes which carry out spectral sensitization of the region of 600–750 nm.

As the sensitizing dyes which carry out spectral sensitization of the region of 600–750 nm, there may be used any dyes with no limitation as far as $\gamma_R$ in the aforementioned method which uses an optical filter having an absorption maximum at about 700 nm does not damage the relation $0.3<\gamma_G/\gamma_B<0.7$ and the relation $0.3<\gamma_G/\gamma_R<1.0$ is satisfied. Examples of the sensitizing dyes are those which are represented by the following formulas (2) and (3).

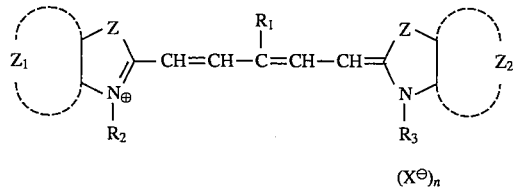

(2)

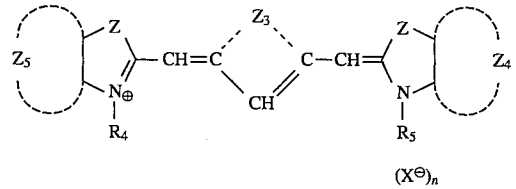

(3)

(wherein $R_1$ represents a hydrogen atom or an alkyl group, $R_2$–$R_5$ each represent an alkyl group or an aryl group, $Z_1$, $Z_2$, $Z_4$ and $Z_5$ each represent a group of atoms necessary to form a benzene ring or a naphthalene ring which condenses with a thiazole ring or a selenazole ring, $Z_3$ represents a group of hydrocarbon atoms necessary to form a 6-membered ring, Z represents a sulfur atom or a selenium atom, $X^-$ represents an anion, and n represents 1 or 2 with a proviso that it is 1 when an internal salt is formed).

Preferably, $R_1$ is a hydrogen atom, a methyl group or an ethyl group. $R_2$, $R_3$, $R_4$ and $R_5$ are preferably straight chain or branched chain alkyl groups of 1–6 carbon atoms and these alkyl groups may have substituents. Examples of the substituents are alkoxy group, aryl group, halogen atom, hydroxyl group, carboxyl group and sulfo group. The aryl groups represented by $R_2$–$R_5$ may have substituents such as carboxyl group and sulfo group. The heterocyclic nuclei formed by $Z_1$, $Z_2$, $Z_4$ and $Z_5$ may have substituents and the substituents are preferably halogen atom, aryl group, alkyl group and alkoxy group and more preferably halogen atom, phenyl group and methoxy group.

The nonlimiting typical examples of the sensitizing dyes represented by the formulas (2) and (3) are shown below.

(2)-1
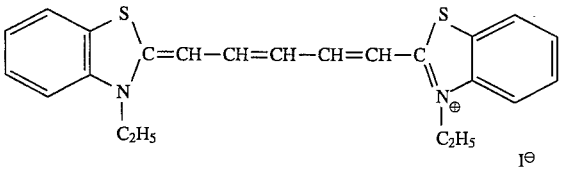
(2)-2
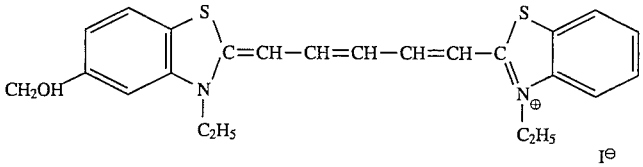
(2)-3
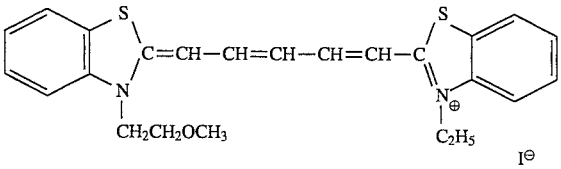
(2)-4
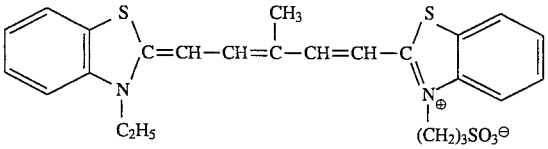
(2)-5
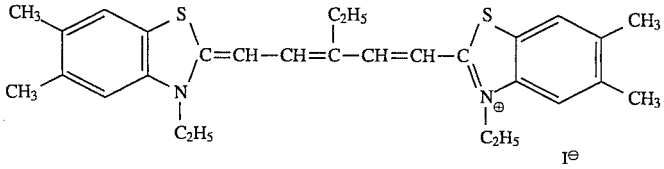
(2)-6
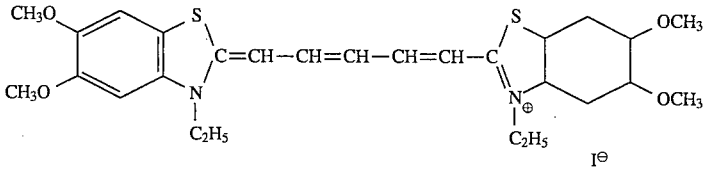
(3)-1
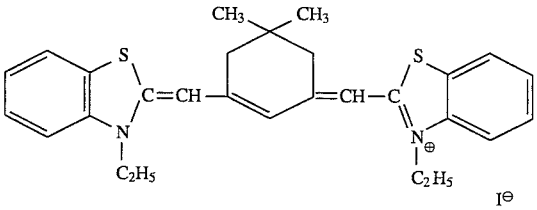
(3)-2
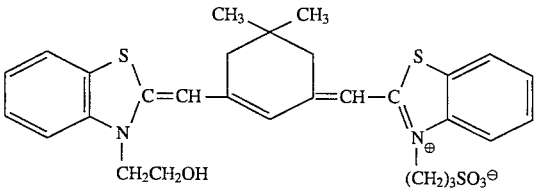
(3)-3
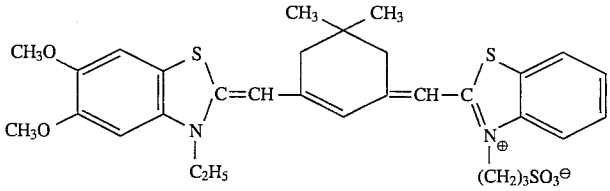

-continued (3)-4

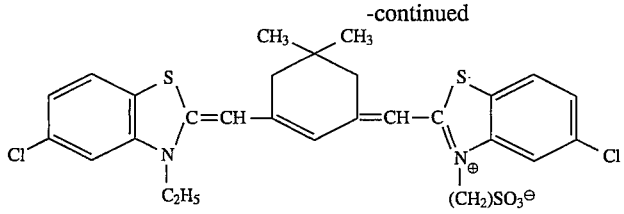

(3)-5

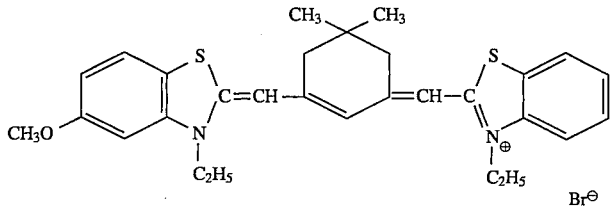

(3)-6

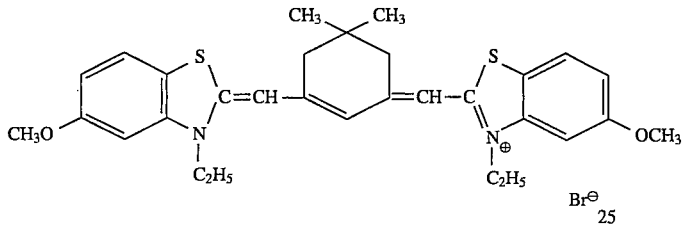

One or more of these sensitizing dyes can be added to the above-mentioned emulsion of high contrast component A, a mixed emulsion of the high contrast component A and the low contrast component B or another emulsion in such an amount as satisfying the relation $0.3<\gamma_G/\gamma_R<1.0$. An optimum amount thereof can be optionally selected from the range of $10^{-6}$–$10^{-2}$ mol, preferably $10^{-5}$–$10^{-3}$ mol for 1 mol of the silver halide.

Next, explanation will be made on the exposing method of the present invention which does not damage the width of contrast variability in printing a black and white negative on the variable contrast printing paper having the above-mentioned adaptability to color negative. The characteristic of the present invention is that when a black and white variable contrast printing paper having the adaptability to printing from the color negative is printed not from color negative, but from a black and white negative, the tone reproduction can be obtained in a wide range of low contrast to high contrast by cutting off the transmitted light of red sensitive wavelength of the printing paper using a C filter mentioned hereinafter in addition to commercially available tone varying filters.

The generally used variable contrast printing papers have a maximum absorption wavelength in blue sensitive portion at about 430 nm and a maximum absorption wavelength in green sensitive portion at about 520–530 nm, and the black and white variable printing paper of the present invention having the adaptability to color negatives is also designed to have similar maximum absorption wavelengths in the blue and green sensitive portions. This is for being able to use the commercially available tone varying filters. However, since the commercially available tone varying filters have transmission for red portion, it is necessary in exposing through a black and white negative to absorb as much as possible the light of the wavelength region of 620–750 nm, more preferably 605–750 nm by using an additional filter (hereinafter referred to as "C filter") so that the black and white variable contrast characteristics are not adversely affected by the spectral sensitivity to the red sensitive portion of the printing paper, and on the other hand, this filter must transmit as much as possible the light of the wavelength region of 400–525 nm, more preferably 400–565 nm for utilizing the spectral sensitivity of blue and green sensitive portions for obtaining the black and white variable contrast characteristics.

Accordingly, the characteristics of the C filters used in the present invention are that they have a transmittance of 10% or less, preferably 5% or less for the light of the wavelength region of 620–750 nm, more preferably 605–750 nm and a transmittance of at least 80%, preferably at least 90% for the light of the wavelength region of 400–525 nm, more preferably 400–565 nm and have a point at which the transmittance for the wavelength region of 570±45 nm is 50% so that black and white variable contrast characteristics can be sufficiently exhibited by absorbing as much as possible the transmitted light to the red sensitive portion and transmitting as much as possible the transmitted light to the blue and green sensitive portions.

However, being different from the black and white negatives, the color negatives are formed of three kinds of dye images of yellow, magenta and cyan and it is necessary to have blue, green and red sensitivities, namely, sensitive region in the whole wavelength region of the visible light in order for obtaining more faithful black and white tone reproduction of the respective colors and excellent graininess and sharpness. Therefore, the C filters used in the method of the present invention are not used in case of printing from color negatives and are used only in case of printing from black and white negatives.

The C filters used in the method of the present invention may be any filters as far as the relation between the wavelength region and the transmittance is within the scope of the present invention. Examples thereof are filters comprising a glass, a film base, a plastic or resin which is coated with a known filter dye or dichroic filters (hereinafter referred to as "D filter").

Next, the variable contrast printing papers of the present invention which are usable for both the color negative and the black and white negative printing will be explained in detail.

When printing of a color negative on a black and white printing paper is considered, it is necessary to consider the black and white reproducibility for all colors of the subject and furthermore, in addition to yellow, magenta and cyan colors which are coloring dyes of color negatives, blue, green and red colors which are produced by two color formation must also be taken into consideration. It is known that the transmission regions in this color negative are generally 500 nm or longer in yellow color, 500 nm or shorter and 600 nm or longer in magenta color, and 600 nm or shorter in cyan color, and further, 400–500 nm in blue color, 500–600 nm in green color and 600 nm or longer in red color. For the color negatives having the above transmission regions, the black and white printing papers for color negative printing are adjusted so that they can be sensitive to all colors formed in the color negatives by subjecting to sensitization of blue sensitivity, green sensitivity and red sensitivity, but characteristics of the black and white printing papers printed through color negatives formed in Y, M and C colors are obtained as characteristics of combination of two components of blue, green and red sensitive characteristics and in the case of a color negative formed in blue, green and red colors, they are obtained as single characteristic of blue, green and red sensitive characteristics of the printing paper, respectively. Therefore, black and white reproduction well balanced with the negative formed in various colors becomes possible by controlling and harmonizing the photographic characteristics of the three sensitive regions of 400–500 nm of blue sensitive region, 500–600 nm of green sensitive region and 600 nm or longer of red sensitive region.

A method of printing through a color negative with varying the tone using a filter is disclosed in Japanese Patent Kokoku (Post Exam. Publn.) No.33-6444. According to this method, a high contrast emulsion and a low contrast emulsion are prepared with differing in the sensitive wavelength of each of the blue sensitive, green sensitive and red sensitive wavelength regions and they are coated in multilayer to obtain panchromatic variable contrast characteristics. However, this patent publication describes only the application to color printing papers and does not describe the application to black and white printing papers. The inventors prepared panchromatic black and white printing papers using this method, but the maximum density of the blackened area of developed silver was not high and color tone (hue of the developed silver) differed in the low density part and the high density part, and as a result, preferred black and white prints could not be obtained. In an attempt to solve these problems, the inventors prepared a panchromatic black and white printing paper by coating in one layer an emulsion having the characteristics of two or more components differing in spectral sensitivity in the blue, green and red sensitive wavelength regions, respectively to find that a preferred black and white print can be obtained which is higher in the maximum density of the blackened area of the developed silver and has a pure black tone as compared with the prints obtained by the method of Japanese Patent Kokoku (Post Exam. Publn.) No.33-6444. This is not suggested in the Japanese Patent Kokoku (Post Exam. Publn.) No.33-6444. Furthermore, in the case of multi-layer coating, minute troubles in coating are apt to occur and in addition, owing to increase of coating amount, the cost for production and the cost for starting materials such as silver nitrate and various chemicals increase and thus, the multi-layer coating is not preferred from the various viewpoints.

The feature of the present invention is that silver halide emulsions of at least two components differing in spectral sensitivity in the respective transmission wavelength regions of a color negative formed in blue, green and red color are coated in one layer to obtain composite photographic characteristics, and by varying the exposure wavelength depending on the tone characteristics of the color negative, the photographic characteristics in the three wavelength regions can be varied simultaneously and in parallel from low contrast to high contrast.

The composite photographic characteristics of silver halide emulsions of at least two components differing in spectral sensitivity in the respective sensitive wavelength regions of 400–500 nm, 500–600 nm and 600 nm or longer can be obtained by preparing and coating the emulsions differing in tone mainly in the respective wavelength regions, but practically, in order to broaden the width of the tone, it is desired that one of the two emulsions is sensitized so that the emulsion is higher than another emulsion in sensitivity in the wavelength region and in addition, the emulsion is adjusted to form the toe of low contrast characteristic curve by reducing the amount of silver. Furthermore, the component which has high sensitivity and forms the toe of low contrast characteristic is desirably an emulsion obtained by mixing emulsions which are dye-sensitized so as to differ in adsorption amount of sensitizing dye per a silver halide grain. Specifically, the emulsions can be prepared by the processes described in Japanese Patent Kokai (Laid-Open) Nos.62- 215943, 4-6550, 4-321026 and 4-324441. In preparing the above silver halide emulsions having different spectral sensitivity, the respective sensitive wavelength regions may partially overlap, but preferably the sensitive maximum wavelengths are distant from each other as much as possible. Moreover, by allowing the emulsion to have the sensitive maximum wavelength at about 500 nm or about 600 nm and using it as one component of the wavelength region of both sides of the sensitive maximum wavelength, namely, both the blue and green sensitive wavelength regions or both the green and red sensitive wavelength regions, the component can be utilized as if it is substantially of two components. With reference to the contrast of printing paper, when printing is carried out using a relatively high contrast color negative obtained by photographing under sunlight, it is desirable for obtaining a proper black and white print to design the printing paper so that the gamma value can be 2.0 or less, more preferably 1.8 or less in all of the above three wavelength regions by selecting tone varying filters. On the other hand, when printing is carried out using a relatively low contrast color negative prepared with under-exposure, it is similarly desirable to design the printing paper so that the gamma value can be 2.5 or more, more preferably 2.8 or more. (The gamma value here shows a slope of characteristic curve from the point of the minimum density+0.04 to the point of the minimum density+(the maximum density –the minimum density)× 0.9.)

The tone varying filters used for the printing paper of the present invention are filters which can vary the tone by selecting the exposure wavelength, and practically, in order that the characteristics of two or more silver halide emulsions differing in spectral sensitivity in each of the sensitive wavelength regions of 400–500 nm, 500–600 nm and 600 nm or longer can be separated, the filters are designed so that they have an absorption spectrum in conformity to the sensitivity maxima of the high contrast components for the filters for obtaining low contrast characteristic and they have similarly an absorption spectrum in conformity to the sensitivity maxima of the low contrast components for the filters for obtaining high contrast characteristic. The absorption amount is adjusted so as to vary depending on the tone characteristics of the color negative.

In order that proper black and white print can be obtained for color negatives different in contrast, printing with the color negatives is carried out by exposing the printing paper through the above tone varying filter which cuts off the low contrast characteristics of the printing paper in the case of low contrast color negative and by exposing the printing paper through the above tone varying filter which cuts off the high contrast characteristics in the case of high contrast color negative. For standard color negatives, the printing paper is exposed by suitably combining the respective filters to adjust the absorption wavelength or is exposed with a white light without using the filters. Furthermore, it is preferred that depending on the contrast of the color negatives, the absorption amount to be cut off is increased with decrease or increase of contrast. In addition, since the black and white negative film does not have dependence on transmission wavelength, the above filter can be used as it is for varying the contrast of the black and white negative film.

As the sensitizing dyes for 400–500 nm used in the present invention, mention may be made of those which are represented by the following formulas (4) and (5), but the present invention is not limited to the use of them.

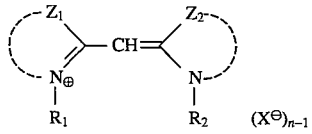

(4)

wherein $Z_1$ and $Z_2$ each represent a group of non-metallic atoms necessary to complete a benzothiazole ring, a benzoselenazole ring, an oxazole ring, a thiazole ring, a selenazole ring, a pyridine ring, a benzoxazole ring, a benzimidazole ring, a naphthoxazole ring, a naphthothiazole ring, a naphthoselenazole ring, a naphthoimidazole ring or a quinoline ring; $R_1$ and $R_2$ each represent an alkyl group, an alkenyl group or an aryl group; $X^-$ represents an anion; and n represents 1 or 2. The heterocyclic ring represented by $Z_1$ and $Z_2$ may have a substituent and the substituent is preferably a halogen atom, an aryl group, an alkyl group, a hydroxyl group or the like. The halogen atom is preferably chlorine atom, the aryl group is preferably phenyl group, the alkyl group is preferably methyl group and the alkoxy group is preferably methoxy group or ethoxy group.

The groups represented by $R_1$ and $R_2$ are preferably alkyl groups, especially preferably straight chain or branched chain alkyl groups of 1–6 carbon atoms, such as methyl group, ethyl group, propyl group and isopropyl group. These alkyl groups may have a substituent. The substituents include sulfo group, carboxy group, hydroxy group, alkoxycarbonyl group and alkylsulfonylamino group. The alkyl groups represented by $R_1$ and $R_2$ are preferably those which are substituted with sulfo group or carboxyl group. The sulfo group, the carboxyl group and the like may form salts with organic cations such as pyridinium ion and triethyl ammonium ion or inorganic cations such as ammonium ion, sodium ion and potassium ion. The anions represented by $X^-$ are preferably chloride ion, bromide ion, iodide ion and the like. When internal salts are formed, the anions may not be contained and in this case, n indicates 1.

Nonlimiting examples of the sensitizing dyes represented by the formula (4) are shown below.

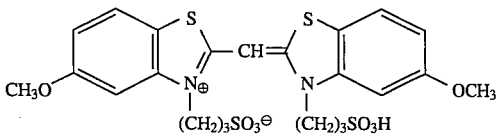

(SB-1)

-continued

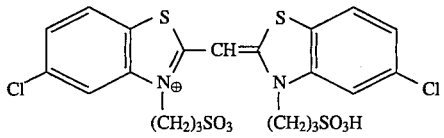

(SB-2)

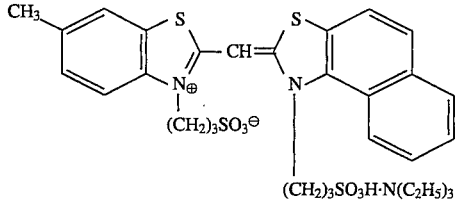

(SB-3)

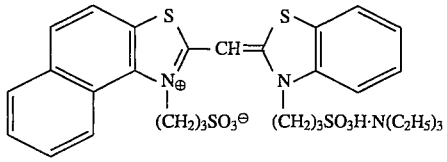

(SB-4)

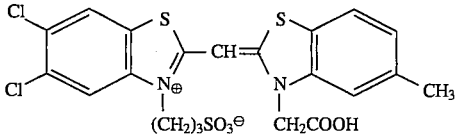

(SB-5)

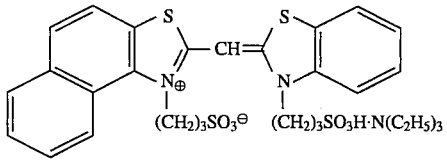

(SB-6)

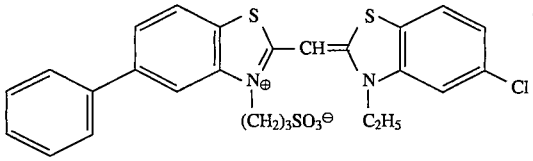

(SB-7)

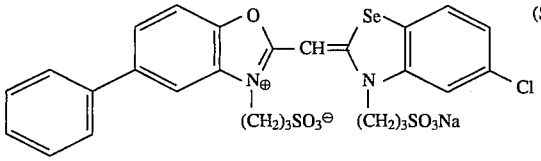

(SB-8)

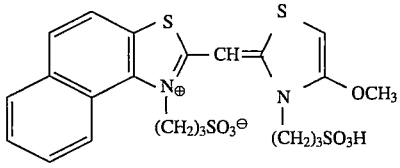

(SB-9)

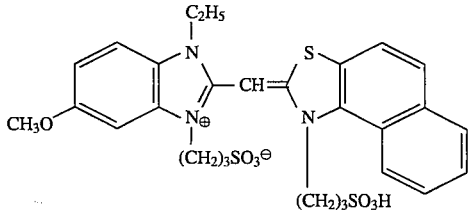

(SB-10)

-continued

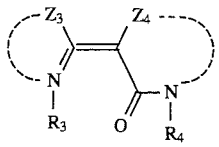

(5)

wherein $Z_3$ represents a group of non-metallic atoms necessary to form a benzothiazole ring, a benzoselenazole ring, a naphthothiazole ring, benzimidazole ring or the like, $Z_4$ represents a group of non-metallic atoms necessary to form a barbituric acid ring, thiobarbituric acid ring, 4-dione ring, 2-thiooxazolidine-2,2-thiohydantoin ring or the like, $R_3$ and $R_4$ each represent an aryl group, an alkyl group or an alkenyl group. Non-limiting examples of the sensitizing dyes represented by the formula (5) are shown below.

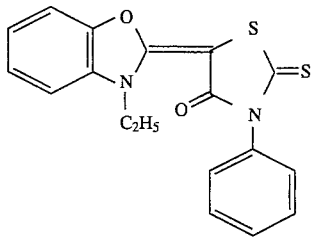

(SB-11)

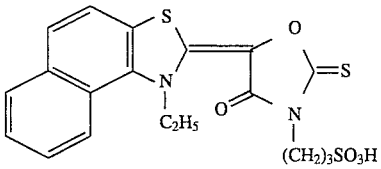

(SB-12)

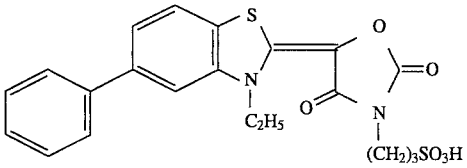

(SB-13)

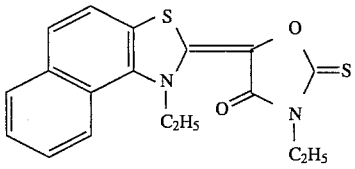

(SB-14)

In addition to the above sensitizing dyes, rhodacyanine sensitizing dyes can also be used and these are generally known.

Typical examples of the sensitizing dyes for 500–600 nm used in the present invention are those which are represented by the following formula (6).

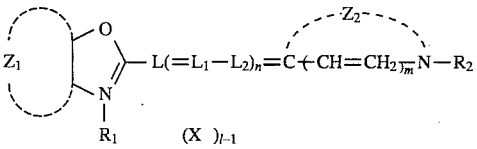

(6)

wherein $R_1$ and $R_2$ may be the same or different and each represent an alkyl group, an alkenyl group or an aryl group, L, $L_1$ and $L_2$ each represent CH or $CR_3$ ($R_3$ is a lower alkyl group or an aryl group), $Z_1$ represents a group of atoms necessary to form a benzoxazole ring having an aryl group or an aralkyl group at at least 5- or 6-position or represents a naphthoxazole ring, $Z_2$ represents a group of atoms necessary to form a 5-or 6-membered nitrogen-containing heterocyclic ring, $X^-$ represents an anion, 1 represents 1 or 2, m represents 0 or 1, and n represents 0, 1 or 2. $R_1$ and $R_2$ which may be the same or different each represent an alkyl group (for example, lower alkyl groups such as methyl, ethyl, propyl, butyl and pentyl, hydroxyalkyl groups such as β-hydroxyethyl and γ-hydroxypropyl, acyloxyalkyl groups such as β-acetoxyethyl, γ-acetoxypropyl and β-benzoyloxyethyl, alkoxyalkyl groups such as β-methoxyethyl, β-ethoxyethyl, β-isopropoxyethyl and β-(β-methoxyethoxy-)ethyl, carboxyalkyl groups such as carboxymethyl, β-carboxyethyl and γ-carboxypropyl, alkoxycarbonylalkyl groups such as methoxycarbonylmethyl, ethoxycarbonylmethyl and β-ethoxycarbonylethyl, sulfoalkyl groups such as β-sulfoethyl, γ-sulfopropyl and δ-sulfobutyl, aralkyl groups such as benzyl and phenethyl, and sulfoaralkyl groups such as sulfobenzyl and sulfophenethyl), an alkenyl group (for example, allyl group) or an aryl group (for example, phenyl group). L, $L_1$ and $L_2$ each represent CH or $CR_3$ ($R_3$ is a lower alkyl group or an aryl group, for example, those referred to for $R_1$ and $R_2$ hereabove), $Z_1$ represents a group of atoms necessary to form a benzoxazole ring having an aryl group (for example, phenyl) or an aralkyl group (for example, benzyl and phenethyl) at at least 5- and/or 6-position or represents a naphthoxazole ring (for example, naphtho[2,1-d]oxazole, naphtho[1,2-d]oxazole, naphtho[2,3-d]oxazole and 8,9-dihydronaphtho[1,2-d]oxazole). $Z_2$ represents a group of atoms necessary to complete a 5- or 6-membered nitrogen-containing heterocyclic ring. The heterocyclic rings are those which are well known in the chemistry of cyanine dyes. Examples of them are oxazoline ring, oxazole ring, benzoxazole ring, naphthoxazole ring, isoxazole ring, benzoisoxazole ring, oxazolopyridine ring, thiazoline ring, thiazole ring, benzothiazole ring, naphthothiazole ring, thiazolopyridine ring, thiazoloquinoline ring, 1,3,4-thiadiazole ring, selenazoline ring, selenazole ring, benzoselenazole ring, naphthoselenazole ring, pyridine ring, quinoline ring, benzo[f]quinoline ring, isoquinoline ring, acridine ring, imidazole ring, benzimidazole ring, naphthimidazole ring, indolenine ring, benzindolenine ring, imidazoloquinoxaline ring, 1,8-naphthyridine ring, and pyrroline ring. $X^-$ represents an acid anion (for example, methylsulfate ion, ethylsulfate ion, thiocyanate ion, toluenesulfonate ion, chloride ion, bromide ion, iodide ion and perchlorate ion), 1 represents 1 or 2, m represents 0 or 1, and n represents 0, 1 or 2.

Nonlimiting typical examples of the dyes represented by the formula (6) are shown below.

(SG-1)
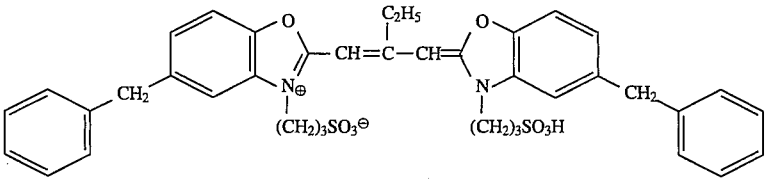
(SG-2)
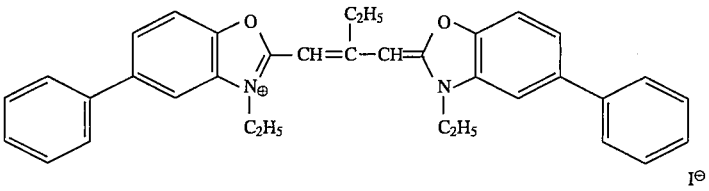
(SG-3)
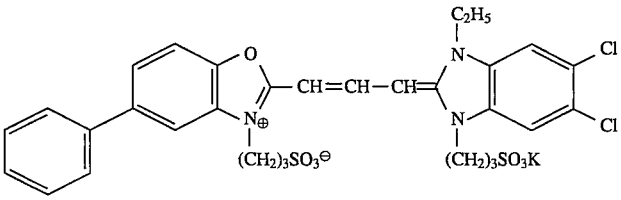
(SG-4)
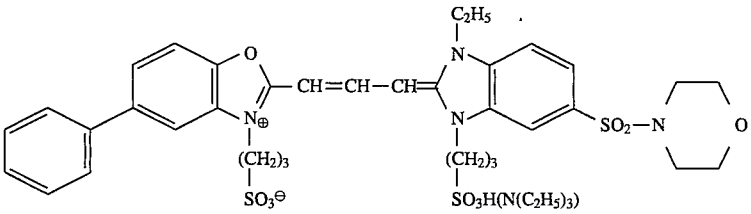
(SG-5)
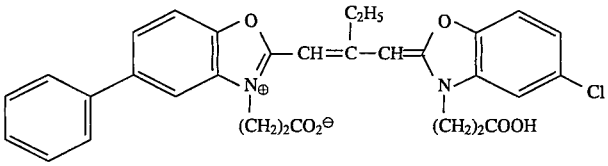
(SG-6)
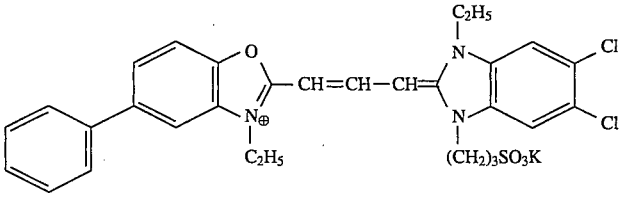
(SG-7)
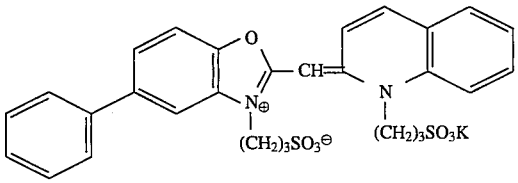
(SG-8)
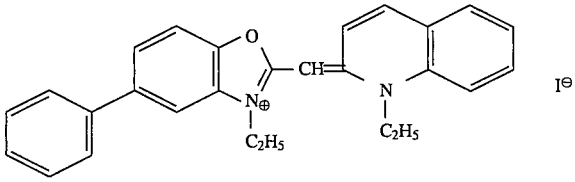

-continued

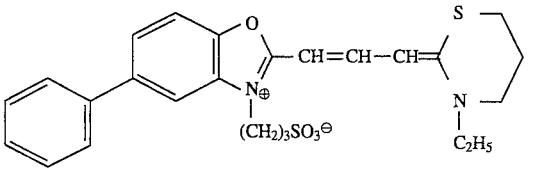

(SG-9)

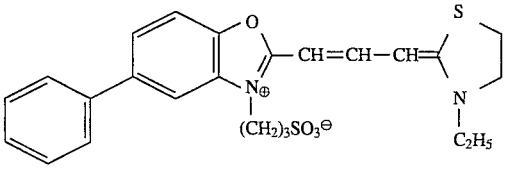

(SG-10)

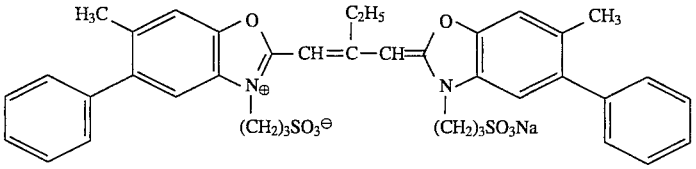

(SG-11)

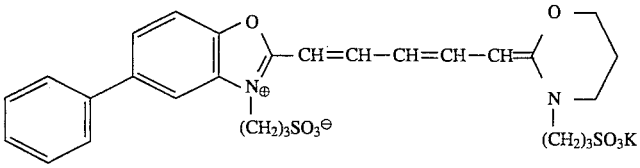

(SG-12)

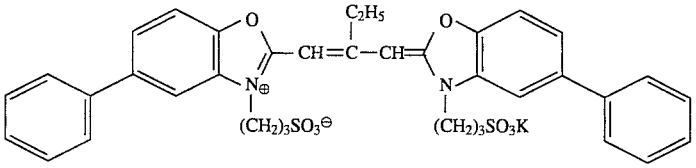

(SG-13)

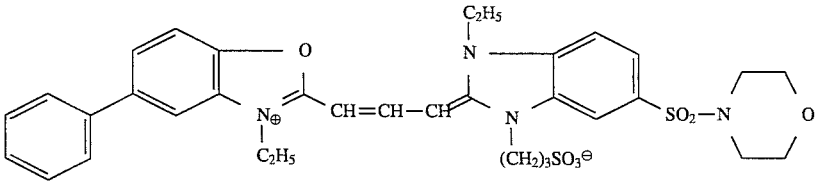

(SG-14)

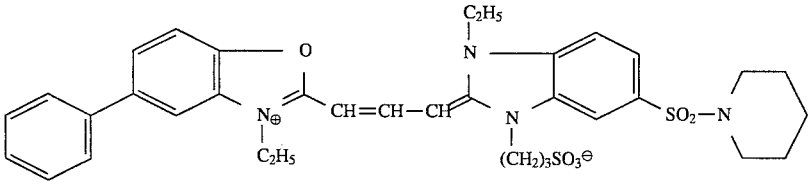

(SG-15)

In addition to the above sensitizing dyes, known merocyanine and rhodacyanine sensitizing dyes can also be used.

Typical examples of the sensitizing dyes used for sensitization of 600 nm or longer in the present invention are represented by the following formulas (7) and (8).

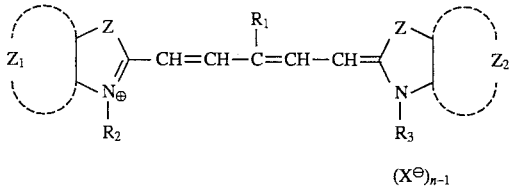

(7)

-continued

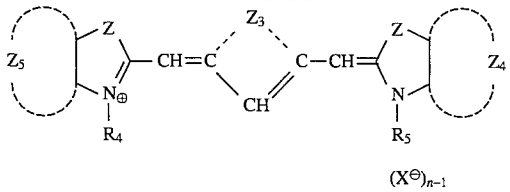

(8)

wherein $R_1$ represents a hydrogen atom or an alkyl group, $R_2$–$R_5$ each represent an alkyl group or an aryl group, $Z_1$, $Z_2$, $Z_4$ and $Z_5$ each represent a group of atoms necessary to form a benzene ring or naphthalene ring which condenses with a thiazole ring or a selenazole ring, $Z_3$ represents a group of hydrocarbon atoms necessary to form a 5- or 6-membered ring, Z represents a sulfur atom or a selenium atom, $X^-$ represents an anion, n represents 1 or 2 and n represents 1 when an internal salt is formed.

$R_1$ is preferably a hydrogen atom, a methyl group or an ethyl group and $R_2$, $R_3$, $R_4$ and $R_5$ are preferably straight or branched chain alkyl groups of 1–6 carbon atoms and the alkyl groups may have substituents. The substituents include, for example, alkoxy groups, aryl groups, halogen atoms, hydroxyl group, carboxyl group and sulfo group. The aryl groups represented by $R_2$–$R_5$ may have substituents such as carboxyl group and sulfo group. The heterocyclic rings formed by $Z_1$, $Z_2$, $Z_4$ and $Z_5$ may have substituents and the substituents are preferably halogen atoms, aryl groups, alkyl groups, and alkoxy groups and more preferably halogen atoms, phenyl group and methoxy group. The nonlimiting typical examples of the sensitizing dyes are shown below.

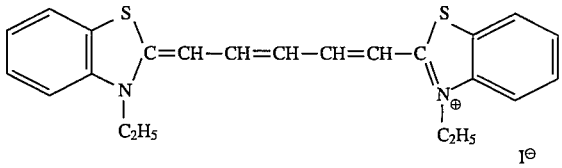
(SR-1)

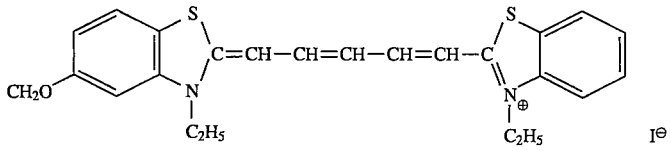
(SR-2)

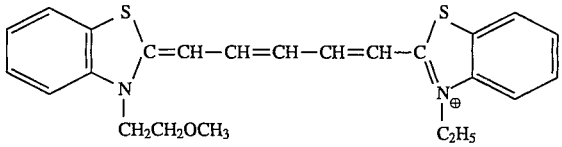
(SR-3)

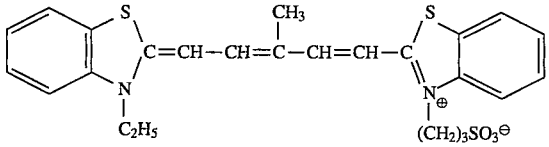
(SR-4)

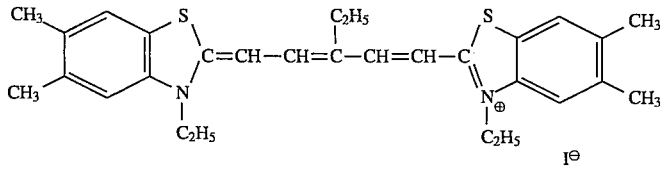
(SR-5)

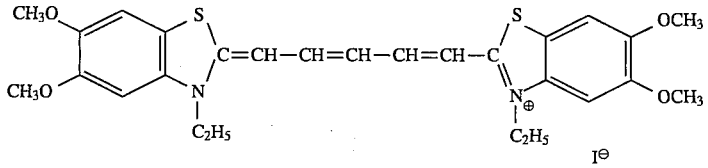
(SR-6)

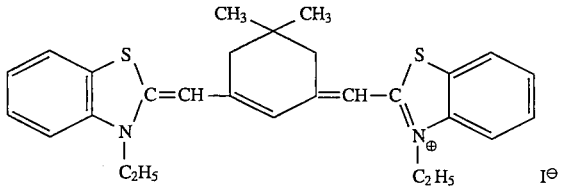
(SR-7)

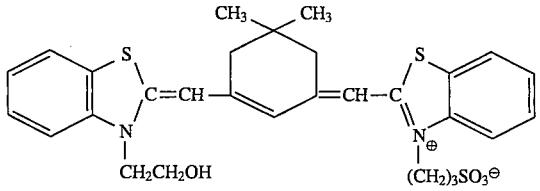
(SR-8)

-continued

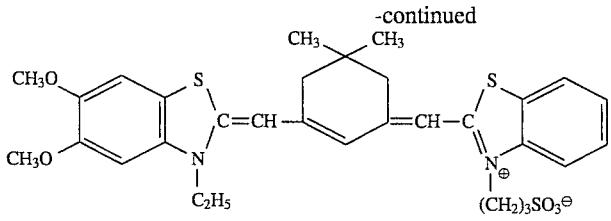

(SR-9)

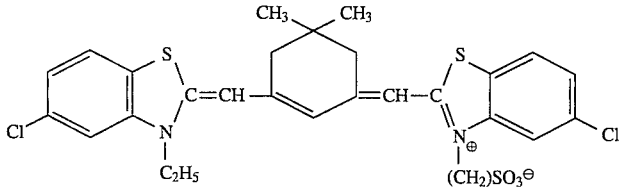

(SR-10)

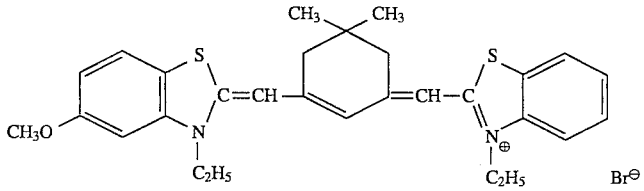

(SR-11)

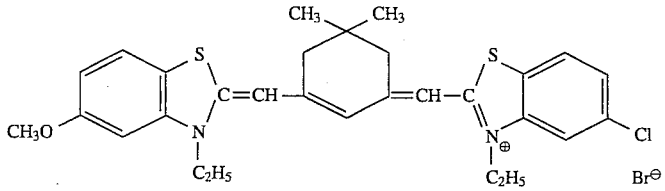

(SR-12)

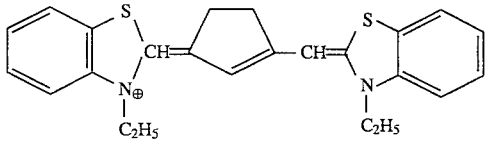

(SR-13)

The above enumerated dyes are typical examples and other known sensitizing dyes can also be used.

The above are representative sensitizing dyes used in the present invention and a wide variety of known sensitizing dyes can be optionally used. These sensitizing dyes can be added to silver halide emulsions as a solution thereof in water or water-miscible organic solvents such as methanol, ethanol and methyl cellosolve and can be adsorbed to a part or all of silver halide grains depending on the desired characteristics. Furthermore, the sensitizing dyes may be added to silver halide emulsions as a solution in water-insoluble solvents or as a dispersion without being dissolved in solvents. Amount of the sensitizing dye in this case varies depending on the kind of the dye and that of the emulsion, but the optimum amount can be optionally selected from the range of generally $10^{-6}$–$10^{-2}$ mol, preferably $10^{-5}$–$10^{-3}$ mol for 1 mol of silver halide. The sensitizing dyes may be added simultaneously or separately at intervals with setting adsorption times depending on the adsorbability of the dyes.

The silver halide used for the photographic emulsion layer may be any of silver bromide, silver iodobromide, silver iodochlorobromide, silver chlorobromide and silver chloride. Preferred is silver iodochlorobromide containing 5 mol % or less of silver iodide. The grain size of the silver halide may be optional, but preferably 0.8μ or smaller. These silver halide emulsions can be prepared by known processes such as ammonia process, neutral process and acidic process. Formation and growth of crystals can be carried out by the well known single jet process, multi jet process and the like.

The emulsions can contain various additives. For example, when they are chemically sensitized with gold compounds, other chemical sensitizers (e.g. sulfur sensitizers such as thiourea and hypo, noble metal sensitizers exclusive of gold and reduction sensitizers) can also be used together. Furthermore, emulsions can contain stabilizers, antifoggants, surface active agents, developing agents, development accelerators, hardeners, hardening accelerators, couplers, desilvering accelerators, dye elimination improvers, brightening agents, thickeners and the like.

As protective colloids for silver halide emulsions, mention may be made of, for example, natural materials such as gelatin, modified gelatin, albumin, agar, gum arabic and alginic acid and water-soluble synthetic resins such as polyvinyl alcohol, polyvinyl pyrrolidone and copolymers of acrylamide, acrylic acid and vinylimidazole.

The emulsions are coated on suitable supports such as glass, cellulose acetate film, polyethylene terephthalate film, paper, baryta paper and polyolefin (e.g., polyethylene or polypropylene)-coated paper. These supports may be subjected to known corona discharge treatments and besides, may be subjected to known subbing treatments.

The silver halide photographic emulsion layer is coated, if necessary, together with a protective layer, an intermediate layer, an ultraviolet absorbing layer or an undercoat layer.

The photosensitive materials prepared using the silver halide emulsions according to the present invention are exposed and thereafter can be developed by known methods. Black and white developers are alkali solutions containing developing agents such as hydroxybenzenes, aminophenols and aminobenzenes used in general photography and in addition, can contain sulfites, carbonates, bisulfites, bromides, iodides, etc. of alkali metals.

The following nonlimiting examples illustrate the present invention.

EXAMPLE 1

A chemically sensitized silver iodochlorobromide emulsion A (silver iodide: 0.4 mol % and silver bromide: 60 mol %, and average grain size: 0.35μ) was subjected to multicomponent dye sensitization using the exemplified sensitizing dye (1)-7 by the following method. That is, the emulsion A in an amount of 30 g in terms of silver nitrate was divided into three portions at 2:4:4 and similarly, 15 mg of the sensitizing dye (1)-7 was divided into three portions at 1.5:4:4.5. The 15% portion of the divided sensitizing dye was added to the 20% portion of the divided emulsion and the mixture was left to stand at 50° C. for 20 minutes. Successively, the 40% portion of the emulsion was added to the mixture and the 40% portion of the sensitizing dye was added thereto when the temperature reached 50° C. and the mixture was left to stand for 10 minutes. Then, the final 40% portion of the emulsion was added and when the temperature reached 50° C., the remaining 45% portion of the sensitizing dye was added and the mixture was left to stand for 10 minutes to sufficiently stabilize the color sensitization (emulsion B).

Temperature of this emulsion B was lowered to 40° C. and the emulsion B was mixed with the emulsion A (30 g in terms of silver nitrate), the amount of the emulsion B being 50% of the emulsion A in terms of the amount of silver (emulsion C). Separately, 3 mg of a red sensitive sensitizing dye (3)-4 was added to the emulsion A (30 g in terms of silver nitrate) at 50° C. and the mixture was left to stand for 20 minutes to stabilize the dye sensitization (emulsion D). This emulsion D was mixed with the emulsion C in an amount of 10%, 50%, 100%, 200% and 400% of the emulsion C in terms of the amount of silver (emulsions E-I). Separately, 4.5 mg of a red sensitive sensitizing dye (3)-4 was added to the emulsion C (45 g in terms of silver nitrate) and the mixture was left to stand for 20 minutes to stabilize the dye sensitization (emulsion J). A stabilizer, a hardener and a surface active agent were added to each of the resulting emulsions and each of the emulsions was coated on a photographic polyethylene-laminated paper at a coating amount of 3 g/m$^2$ in terms of silver nitrate. For evaluation of the characteristics of the resultant samples, the samples were heated at 40° C. for 1 day and exposed through optical filters having a transmission maximum at about 430 nm, about 540 nm and about 700 nm (Kodak Wratten filters referred to hereabove) and a wedge having a density difference of 0.15. Then, the exposed samples were developed with D-72 developer (manufactured by Kodak Co.) at 20° C. for 90 seconds, fixed and washed with water. $\gamma_B$, $\gamma_G$ and $\gamma_R$ which denote the gradient (gamma) between the reflective density of 0.02 and the density of 90% of the maximum reflective density were obtained and the values of $\gamma_G/\gamma_B$ and $\gamma_G/\gamma_R$ are shown in Table 1.

TABLE 1

| Sample | 1 | 2 | 3 | 4 | 5 | 6 | 7 |
|---|---|---|---|---|---|---|---|
| Emulsion | C | E | F | G | H | I | J |
| γG/γB | 0.51 | 0.48 | 0.42 | 0.34 | 0.21 | 0.13 | 0.75 |
| γG/γR | — | 2.10 | 0.74 | 0.51 | 0.25 | 0.14 | 0.68 |

The above samples were exposed through Kodak POLYCONTRAST FILTER (Nos.0–5) and a black and white wedge having a density difference of 0.15 and then, developed with GEKKOL (developer for printing paper manufactured by Mitsubishi Paper Mills Ltd.) at 20° C. for 90 seconds to find that sample Nos.1–4 had good characteristics of a variable contrast black and white printing paper. Then, the samples were subjected to printing with white light using FUJI SUPER HG 400 standard negative as a color negative and an enlarger 7451 manufactured by LPL Co. and similarly developed with GEKKOL developer for printing paper at 20° C. for 90 seconds to find that sample Nos.3 and 4 satisfactorily reproduced the tone of a color print separately prepared by printing on a color printing paper while sample Nos.1, 2 and 5–7 were inferior in balancing of tones of Y, M and C and were not suitable for being printed with a color negative.

EXAMPLE 2

Emulsion B-2 was prepared in the same manner as in preparation of the emulsion B in Example 1 except that sensitizing dye (1)-11 was used in place of the sensitizing dye (1)-7. This emulsion B-2 was mixed with the emulsion A (30 g in terms of silver nitrate) in an amount of 1.5 time the amount of the emulsion A in terms of silver to obtain emulsion C-2. Separately, to the emulsion A (30 g in terms of silver nitrate) was added 3 mg of the red sensitive sensitizing dye (3)-1 at 50° C. to obtain emulsion D-2. This emulsion D-2 was mixed with the emulsion C-2 in an amount of 10%, 50%, 100%, 200% and 400% of the emulsion C-2 in terms of the amount of silver to obtain emulsions E-2–I-2. Separately, 7.5 mg of a red sensitive sensitizing dye (3)-1 was added to the emulsion C-2 (75 g in terms of silver nitrate) at 50° C. to obtain emulsion J-2. A stabilizer, a hardener and a surface active agent were added to each of the resulting emulsions and immediately, each of the emulsions was coated on a photographic polyethylene-laminated paper at a coating amount of 3 g/m$^2$ in terms of silver nitrate. For evaluation of the characteristics of the resultant samples, each of the samples was heated at 40° C. for 1 day and exposed through the optical filters used in Example 1 and a wedge having a density difference of 0.15. Then, the exposed sample was developed with D-72 developer (manufactured by Kodak Co.) at 20° C. for 90 seconds, fixed and washed with water. $\gamma_B$, $\gamma_G$ and $\gamma_R$ which denote the gradient (gamma) between the reflective density of 0.02 and the density of 90% of the maximum reflective density were obtained and the values of $\gamma_G/\gamma_B$ and $\gamma_G/\gamma_R$ are shown in Table 2.

TABLE 2

| Sample | 11 | 12 | 13 | 14 | 15 | 16 | 17 |
|---|---|---|---|---|---|---|---|
| Emulsion | C-2 | E-2 | F-2 | G-2 | H-2 | I-2 | J-2 |
| γG/γB | 0.58 | 0.54 | 0.50 | 0.47 | 0.32 | 0.18 | 0.61 |
| γG/γR | — | 2.85 | 1.27 | 0.76 | 0.52 | 0.26 | 0.56 |

These samples were exposed through Kodak POLYCONTRAST FILTER (Nos.0–5) and a black and white wedge having a density difference of 0.15 and then, developed with GEKKOL (developer for printing paper manufactured by Mitsubishi Paper Mills Ltd.) at 20° C. for 90 seconds to find that sample Nos.11–15 and 17 had good characteristics of a variable contrast black and white printing paper. Then, these samples were subjected to printing with white light using FUJI SUPER HG 400 standard negative as a color negative and an enlarger 7451 manufactured by LPL Co. and similarly developed with GEKKOL (developer for printing paper) at 20° C. for 90 seconds to find that sample Nos.14, 15 and 17 satisfactorily reproduced the tone of a color print separately prepared by printing on a color printing paper while sample Nos.11, 12, 13 and 16 were inferior in balancing of tones of Y, M and C and were not suitable for being printed with a color negative film.

EXAMPLE 3

Printing was carried out using the printing papers of sample Nos.11 and 17 of Example 2 through the black and white wedge. In this case, as C filter used in the present invention and for comparison, a dichroic filter (hereinafter referred to as "D filter") made by vapor depositing a cyan component on the surface of a glass as described in Yoshinaga, "Handbook of Applied Spectroscopy (1973) and Kubota et al, "Handbook of Optical Technique" (1968) was used.

The exposure was carried out with putting a tone varying filter (manufactured by Mitsubishi Paper Mills Ltd.) and the cyan D filter in combination between the printing paper and a light source lamp and with using a black and white wedge of 0.1 in difference of transmission density.

Sample No.17 was exposed using (1) a D filter produced so that it transmitted 91–96% of a light of 400–567 nm and it had a transmittance of 1–2% for a light of 604–750 nm and a transmittance of 50% for a light of 575 nm and tone varying filters for Nos.0, 3 and 5 tones to obtain a black and white print. As comparative tests, sample No.17 was exposed using (2) a D filter produced so that it transmitted 92–96% of a light of 400–517 nm (transmittance for 525 nm was 74%) and had a transmittance of 1–3% for a light of 569–750 nm and a transmittance of 50% for a light of 541 nm, (3) a D filter produced so that it transmitted 93–97% of a light of 400–598 nm and had a transmittance of 2–5% for a light of 632–750 nm (transmittance for 620 nm was 34%) and a transmittance of 50% for a light of 608 nm and (4) only the tone varying filters without using D filter. Furthermore, sample No.11 was similarly exposed using (5) only the tone varying filters.

These samples were developed with Gekkol (developer for printing paper manufactured by Mitsubishi Paper Mills Ltd.) at 20° C. for 60 seconds, fixed with DIASUPER FIX (manufactured by Mitsubishi Paper Mills Ltd.) and washed with running water. Sensitivity and gamma of the resulting prints were measured and the results are shown in Table 3. The sensitivity was measured in the following manner: Density of the prints obtained using the black and white wedge was measured by a reflective densitometer and the sensitivity was defined to be a reciprocal of logarithm of the exposure necessary to obtain the density of 1.0, and is expressed in terms of a relative value when the sensitivity in the case of the above (5) is assumed to be 100. The gamma is a slope of the characteristic curve between a point of the minimum density+0.04 and a point of the minimum density+(the maximum density–the minimum density)×0.9.

TABLE 3

| No. | Cyan D filter | Transmittance of cyan D filter for wavelength region | | | | Tone varying filter | Sensitivity | Gamma |
|---|---|---|---|---|---|---|---|---|
| (1) | Used | 400~ | 567 nm → | 91~ | 96% | #0 | 96 | 1.71 |
| The present | | | 575 nm → | | 50% | #3 | 97 | 2.69 |
| invention | | 604~ | 750 nm → | 1~ | 2% | #5 | 98 | 3.45 |
| (2) | Used | 400~ | 517 nm → | 92~ | 96% | #0 | 64 | 1.81 |
| Comparative | | | 541 nm → | | 50% | #3 | 83 | 2.72 |
| Sample | | 569~ | 750 nm → | 1~ | 3% | #5 | 95 | 3.46 |
| (3) | Used | 400~ | 598 nm → | 93~ | 97% | #0 | 108 | 2.30 |
| Comparative | | | 608 nm → | | 50% | #3 | 108 | 3.03 |
| Sample | | 632~ | 750 nm → | 2~ | 5% | #5 | 109 | 3.49 |
| (4) | Not used | | — | | | #0 | 127 | 2.55 |
| Comparative | | | | | | #3 | 121 | 3.20 |
| Sample | | | | | | #5 | 129 | 3.50 |
| (5) | Not used | | — | | | #0 | 100 | 1.75 |
| Comparative | | | | | | #3 | 100 | 2.69 |
| Sample | | | | | | #5 | 100 | 3.48 |

It can be seen from Table 3 that according to the printing method (1) using the filters of the present invention, since the transmitted light of red sensitive region is absorbed and transmitted lights to blue and green sensitive regions necessary for black and white variable contrast characteristics are hardly absorbed, a sensitivity and a tone reproduction similar to those of the comparative sample (5) which is a variable contrast printing paper are obtained from a black and white variable contrast paper having panchromatic adaptability. In the case of the comparative sample (2), sensitivity decreases because a transmitted light to the green sensitive region which forms a low contrast component of black and white variable contrast characteristics is also absorbed. In the case of the comparative sample (3), a transmitted light for red sensitive region of 632 nm or longer is absorbed, but the sensitive wavelength region of red sensitive portion having the maximum absorption wavelength at 650 nm broadly extends to the shorter wavelength side (generally, the sensitizing dye of red sensitive part has a gentle sensitive wavelength region from the maximum absorption wavelength to the shorter wavelength side), the spectral sensitivity of the red sensitive portion remains and the characteristics of red sensitive portion are included in the black and white variable contrast characteristics to damage the tone reproduction. It can be seen that in the case of the comparative sample (4), all characteristics of the red sensitive portion are included in the black and white variable contrast characteristics and tone reproduction is considerably damaged.

EXAMPLE 4

In the same manner as in Example 1, the sample 17 was exposed using (A) the D filter used in (1) of Example 1 according to the present invention, (B) a D filter prepared so that it transmitted 69–78% of a light of 400–567 nm and had a low transmittance of 1–4% for a light of 601–750 nm and a transmittance of 50% for a light of 578 nm, (C) a D filter prepared so that it transmitted 92–95% of a light of 400–569 nm and had a transmittance of 12–19% for a light of 596–750 nm and a transmittance of 50% for a light of 577 nm, and (D) a D filter prepared so that it transmitted 73–78% of a light of 400–565 nm and had a transmittance of 23–31% for a light of 594–750 nm and a transmittance of 50% for a light of 580 nm, and furthermore, the sample 11 was exposed in the same manner as in Example 1 using (E) only the tone varying filter. Sensitivity and gamma were measured on the resulting prints and the results are shown in Table 4.

TABLE 4

| No. | Cyan D filter | Transmittance of cyan D filter for wavelength region | | | | Tone varying filter | Sensitivity | Gamma |
|---|---|---|---|---|---|---|---|---|
| (A) | Used | 400~ | 567 nm → | 91~ | 96% | #0 | 98 | 1.73 |
| The present | | | 575 nm → | | 50% | #3 | 97 | 2.69 |
| invention | | 604~ | 750 nm → | 1~ | 2% | #5 | 97 | 3.47 |
| (B) | Used | 400~ | 567 nm → | 69~ | 78% | #0 | 56 | 1.84 |
| Comparative | | | 578 nm → | | 50% | #3 | 58 | 2.82 |
| Sample | | 601~ | 750 nm → | 1~ | 4% | #5 | 61 | 3.41 |
| (C) | Used | 400~ | 569 nm → | 92~ | 95% | #0 | 125 | 2.28 |
| Comparative | | | 577 nm → | | 50% | #3 | 122 | 3.16 |
| Sample | | 596~ | 750 nm → | 12~ | 19% | #5 | 119 | 3.51 |
| (D) | Used | 400~ | 565 nm → | 73~ | 78% | #0 | 104 | 2.45 |
| Comparative | | | 580 nm → | | 50% | #3 | 102 | 3.23 |
| Sample | | 594~ | 750 nm → | 13~ | 21% | #5 | 101 | 3.54 |
| (E) | Not used | | — | | | #0 | 100 | 1.72 |
| Comparative | | | | | | #3 | 100 | 2.68 |
| Sample | | | | | | #5 | 100 | 3.46 |

From the results of Table 4, it can be seen that the comparative sample (B) is low in sensitivity since transmittance for the transmitted light to blue and green sensitive portions is low. In the case of the comparative sample (C), since the transmittance for the transmitted light to red sensitive portion is high, the characteristics of red sensitive portion are included in the black and white variable contrast characteristics to damage the tone reproduction. In the case of the comparative sample (D), since the transmittance for the transmitted light to blue and green sensitive portions is low and the transmittance for the transmitted light to red sensitive portion is high, the sensitivity is similar, but the tone reproduction is damaged.

EXAMPLE 5

2.5 mg of sensitizing dye (SR-13) having the sensitivity maximum at 610 nm and capable of being utilized for spectral sensitization of both the green and red sensitive regions was added to a silver iodochlorobromide emulsion (silver iodide: 0.4 mol %, silver bromide: 60 mol % and average grain size: 0.35μ)(30 g in terms of silver nitrate) having a sensitivity maximum of inherent sensitivity at 430 nm and the emulsion was subjected to dye ripening at 50° C. for 15 minutes to obtain emulsion (i).

Then, the dye sensitized emulsion (30 g in terms of silver nitrate) was divided into four portions at 2:2:2:4. To the first 20% portion of the emulsion was added 0.3 mg of the sensitizing dye SR-11 having a sensitivity maximum at 700 nm (emulsion (ii)). To the next 20% portion of the emulsion was added 0.5 mg of a sensitizing dye (SG-5) having a sensitivity maximum at 540 nm in another container (emulsion (iii)). To the another 20% portion of the emulsion was added 0.6 mg of sensitizing dye (SB-14) having a sensitivity maximum at 480 nm (emulsion (iv)). These emulsions were subjected to dye ripening at 50° C. for 15 minutes. The sensitizing dye was not added to the final 40% portion of the emulsion. These four emulsions were mixed just before coating and to the mixture were added additives necessary to coat, such as active agents, antifoggants, fluorescent brighteners and hardeners. The mixture was coated on a photographic polyethylene-laminated paper in one layer at a coating amount of 3 g/m$^2$ in terms of silver nitrate and heated at 40° C. for 1 day to prepare a printing paper. In order to compare the one-layer coating of the present invention with four-layer coating as multi-layer coating, to each of the above four emulsions were added the same additives as above and each of the emulsions was coated on the paper to form four layers to obtain a printing paper. In this case, the coating amount in terms of silver nitrate was 3 g/m$^2$ in total of four layers.

Color tone varying filters were prepared by coating a gel solution of the following filter dyes having a sharp absorption at around the sensitivity maximum wavelength of each dye sensitization on a film base so that the transmittance at the respective maximum absorption wavelengths was 50%.

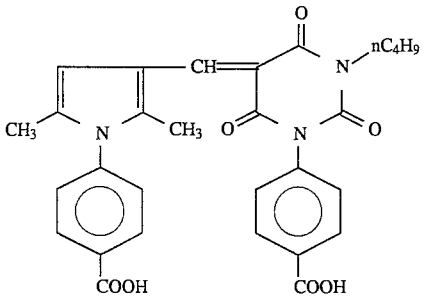

(A) 430 nm cutting dye

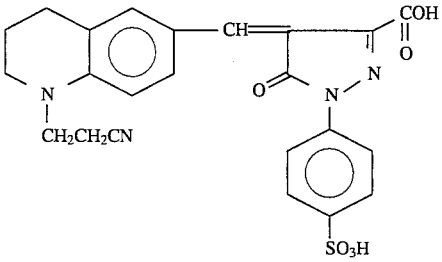

(B) 480 nm cutting dye

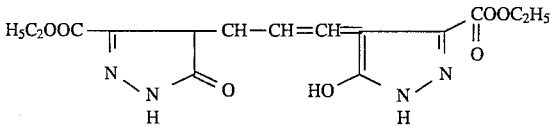

(C) 540 nm cutting dye

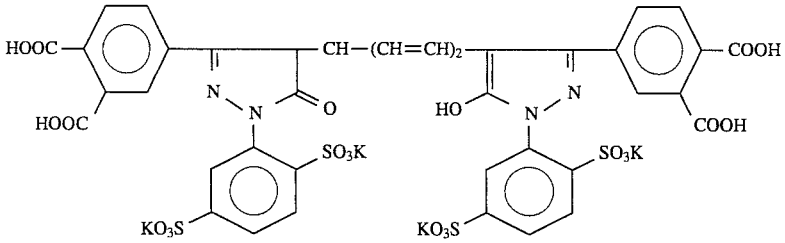

(d) 600 nm cutting dye

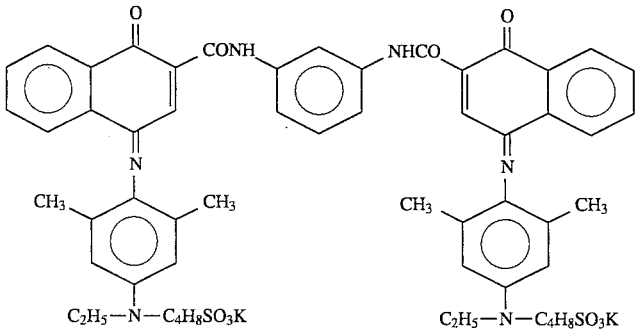

(E) 700 nm cutting dye

The tone varying filters prepared here are for obtaining different tones by selecting exposure wavelength in each of the wavelength region of composite characteristics of at least two components differing in spectral sensitivity in each of the blue, green and red wavelengths of the silver halide emulsion. The above filters (B), (C) and (E) are for obtaining high contrast characteristics by designing to have absorptions adapted to the sensitivity maxima of spectral sensitivity of the emulsions (ii), (iii) and (iv) which will mainly form the toe of low contrast characteristics. On the other hand, the filters (A) and (D) are for obtaining low contrast characteristics by designing to have absorptions adapted to the sensitivity maxima of spectral sensitivity of the emulsion (i) which will form the shoulder of high contrast characteristics. Furthermore, as wedges for evaluation, color negatives of yellow, magenta, cyan, blue, green and red were obtained by subjecting color films to exposure to 467 nm for yellow, 541 nm for magenta, 641 for cyan, 541 nm and 641 nm for blue, 467 nm and 641 nm for green, and 467 nm and 541 nm for red using interference filters and then developing the exposed films. The resulting samples had a transmittance of 50% at 630 nm for yellow color, 40% at 650 nm for magenta, 14% at 550 nm for cyan, 14% at 450 nm for blue, 14% at 550 nm for green and 41% at 650 nm for red. Each of these color films and a gray step wedge having a difference of transmission density of 0.1 were put together to make blue, green, red, yellow, magenta and cyan wedges. The above-mentioned printing paper coated with one layer was brought into close contact with each of the wedges and exposed to white light. Then, each was exposed through the three tone varying filters (B), (C) and (E) to obtain high contrast characteristics and exposed through the two tone varying filters (A) and (D) to obtain low contrast characteristics. The transmittances at the respective wavelengths in this case are as shown in Table 5. These samples were developed with GEKKOL (a developer for printing paper manufactured by Mitsubishi Paper Mills Ltd.) at 20° C. for 90 seconds. Sensitivity (a relative value when the characteristic obtained using the blue wedge was measured by reflective densitometer and when the sensitivity in the case of the sensitivity being 1.0 was assumed to be 100) and gamma were measured and the results are shown in Table 6.

TABLE 5

| | Combination of tone varying filters (B) (C) (E) | Combination of tone varying filters (A) (D) |
|---|---|---|
| Transmittance for 430 nm | 50% | 19% |
| Transmittance for 480 nm | 35% | 63% |
| Transmittance for 540 nm | 15% | 75% |
| Transmittance for 600 nm | 68% | 38% |
| Transmittance for 700 nm | 28% | 80% |

TABLE 6

| One-layer coated sample of the present invention Color negative wedge | Tone varying filter (No filter) White light Sensitivity | Gamma | (B) + (C) + (E) Sensitivity | Gamma | (A) + (D) Sensitivity | Gamma |
|---|---|---|---|---|---|---|
| Blue | 100 | 2.0 | 100 | 3.3 | 100 | 1.6 |
| Green | 95 | 1.9 | 100 | 2.8 | 110 | 1.5 |
| Red | 120 | 2.1 | 140 | 2.9 | 110 | 1.6 |
| Yellow | 135 | 2.2 | 145 | 3.0 | 135 | 1.7 |
| Magenta | 115 | 2.3 | 130 | 3.3 | 125 | 1.7 |
| Cyan | 100 | 2.1 | 115 | 2.9 | 135 | 1.7 |

It can be seen from Table 6 that all colors of color negatives can be widely reproduced from low contrast characteristic to high contrast characteristic by using tone varying filters in combination. Furthermore, it can be seen that since high contrast characteristic can be obtained in the blue, green and red wavelength regions by combination of the three tone varying filters (B), (C) and (E), the emulsion (i) forms the high contrast characteristic and since low contrast characteristic can be obtained by combination of the two tone varying filters (A) and (D), the emulsions (ii), (iii) and (iv) form toe of the low contrast characteristic in the blue, green and red wavelength regions.

EXAMPLE 6

In the same manner as in Example 1, evaluation of characteristics was conducted with white light using the comparative samples coated with four layers and the samples of the present invention coated with one layer which were prepared in Example 5. The results including the values measured at the point of the highest density as the maximum density in this case are shown in Table 7.

TABLE 7

| Color negative wedge | (The present invention) One layer Sensitivity | Gamma | Maximum density | (Not the present invention) Four layers Sensitivity | Gamma | Maximum density |
|---|---|---|---|---|---|---|
| Blue | 100 | 2.0 | 2.10 | 100 | 1.8 | 1.90 |
| Green | 95 | 1.9 | 2.05 | 95 | 1.6 | 1.85 |
| Red | 120 | 2.1 | 2.10 | 115 | 1.9 | 1.95 |
| Yellow | 135 | 2.2 | 2.10 | 130 | 1.8 | 1.90 |
| Magenta | 115 | 2.3 | 2.15 | 115 | 1.9 | 1.95 |
| Cyan | 100 | 2.1 | 2.10 | 100 | 1.8 | 1.90 |

It can be seen from Table 7 that the samples outside the present invention coated with four layers were lower in the maximum density than the samples of the present invention coated with one layer and so, decreased in the gamma value. Thus, it can be seen that the higher maximum density was obtained by employing one layer in spite of the silver amount being the same and the one layer samples had more preferable photographic characteristics as black and white printing papers.

EXAMPLE 7

Dye sensitized emulsions necessary to form the toe of low contrast characteristic were prepared in the same manner as in Example 5 using the sensitizing dyes of Table 8 in combination as shown in Table 8. The high contrast emulsion in this case was the emulsion (i) of Example 5 and the following samples were prepared using this emulsion. Sample (1) was prepared in the same manner as in Example 5 and this was employed as a comparative sample. Furthermore, the following samples were prepared to fully examine the toe characteristics necessary to form the low contrast characteristics. Sample (2) was prepared as follows: After the high contrast emulsion (i) in an amount of 30 g in terms of silver nitrate was obtained, this emulsion was divided into two portions at 1:1. To one of the divided emulsions were added in succession 0.7 mg of the sensitizing dye SR-11, 1.2 mg of the sensitizing dye SG- 5 and 1.4 mg of the sensitizing dye SB-14 and this emulsion was subjected to dye ripening at 50° C. for 15 minutes and no sensitizing dyes were added to another emulsion and the procedure of Example 5 was repeated. Sample (3) was prepared as follows: After the high contrast emulsion (i) in an amount of 30 g in terms of silver nitrate was obtained, to the entire emulsion were added 1.4 mg of the sensitizing dye SR-11, 2.4 mg of the sensitizing dye SG-5 and 2.8 mg of the sensitizing dye SB-14 and then, the preparation was carried out in the same manner as in preparation of sample (2). Sample (4) was prepared as follows: The high contrast emulsion (i) was divided into four portions at 2:2:2:4. 0.3 mg of the sensitizing dye SR-5 was added to one of the 20% portions of the emulsion, 0.5 mg of SG-12 was added to another 20% portion of the emulsion, 0.6 mg of SB-13 was added to the remaining 20% portion of the emulsion, and no sensitizing dye was added to the 40% portion of the emulsion, and the preparation was carried out in the same manner as in the preparation of the sample (2). Sample (5) was prepared as follows: The high contrast emulsion (i) was divided into three portions at 2:3:5. 0.3 mg of the sensitizing dye SR-11 was added to the 20% portions of the emulsion, 1.2 mg of SG-5 and 1.4 mg of SB-14 were added to the 50% portion of the emulsion and no sensitizing dye was added to the remaining 30% portion of the emulsion, and the preparation was carried out in the same manner as in the preparation of the sample (2). Sample (6) was prepared in the same manner as in Example 5 except that the sensitizing dye SR-11 was not used. Sample (7) was prepared as follows: The high contrast emulsion (i) was divided into three portions at 2:2:6. 0.3 mg of the sensitizing dye SR-11 was added to the 20% portion of the emulsion, 0.5 mg of SG-4 was added to another 20% portion of the emulsion and no sensitizing dye was added to the remaining 60% portion of the emulsion, and the preparation was carried out in the same manner as in the preparation of the sample (2). In this case, the sensitizing dye (SG-4) used for the sample (7) was a dye having sensitive maximum utilizable for both the characteristics of blue sensitive and green sensitive wavelength regions.

For evaluation of the resulting samples, three kinds of color negatives differing in contrast were prepared by printing a Macbeth color chart using Fuji Super G 100. The samples were printed using the tone varying filters and an enlarger 7451 manufactured by LPL Co., Ltd. In this case, the tone varying filters were provided under the lens. Furthermore, in order to reduce the effect of the Y color image having poor graininess in the color negative on the black and white print, exposure was carried out using a color CC filter Y10 in addition to the tone varying filters. These samples were developed in the same manner as in Example 5 and the resulting prints were visually evaluated on tone reproducibility, color reproducibility, graininess and sharpness. A standard black and white negative was prepared simultaneously with preparation of the color negatives and a standard black and white print was obtained by printing in No.3 tone MITSUBISHI GEKKO MULTI MD-F using the tone varying filter. This was used for the evaluation. The results of evaluation using the standard black and white print are shown in Table 8 in the following criteria.

⊙: Similar to the standard print.

○: Somewhat inferior to the standard print.

Δ: Inferior to the standard sample, but acceptable.

x: Unusable.

TABLE 8

| | Other dye sensitization based on emulsion (i) | | | | Tone varying filter used in combination with color CC filter and evaluation of print obtained | | | |
|---|---|---|---|---|---|---|---|---|
| Sample | Sensitizing dye | Sensitivity maximum wavelength region | Proportion of emulsion | Color negative used | B + C + E | No | A + D | Evaluation |
| (1) The present invention | SB-14<br>SG-5<br>SR-11 | 480 nm<br>540 nm<br>700 nm | 20%<br>20%<br>20% | Low contrast<br>Standard<br>High contrast | ⊙<br>Δ<br>x | Δ<br>⊙<br>Δ | x<br>Δ<br>⊙ | Having a broad tone variability |
| (2) The present invention | SB-14<br>SG-5<br>SR-11 | 480 nm<br>540 nm<br>700 nm | 50%<br>50%<br>50% | Low contrast<br>Standard<br>High contrast | ⊙<br>Δ<br>x | Δ<br>○<br>x | Δ<br>⊙<br>○ | Having a tone variability |
| (3) Not the present invention | SB-14<br>SG-5<br>SR-11 | 480 nm<br>540 nm<br>700 nm | 100%<br>100%<br>100% | Low contrast<br>Standard<br>High contrast | ⊙<br>Δ<br>x | ⊙<br>Δ<br>x | ⊙<br>Δ<br>x | Having no tone variability |
| (4) The present invention | SB-13<br>SG-12<br>SR-5 | 495 nm<br>560 nm<br>740 nm | 20%<br>20%<br>20% | Low contrast<br>Standard<br>High contrast | Δ<br>○<br>Δ | Δ<br>⊙<br>Δ | x<br>Δ<br>⊙ | Having a tone variability, but filter unsuitable |
| (5) The present invention | SB-14<br>SG-5<br>SR-11 | 480 nm<br>540 nm<br>700 nm | 50%<br>50%<br>20% | Low contrast<br>Standard<br>High contrast | ⊙<br>Δ<br>x | Δ<br>○<br>x | Δ<br>○<br>○ | Having a tone variability |
| (6) Not the present invention | SB-14<br>SG-5<br>— | 480 nm<br>540 nm<br>— | 20%<br>20%<br>— | Low contrast<br>Standard<br>High contrast | ⊙<br>Δ<br>x | x<br>x<br>x | x<br>x<br>x | Having no tone variability for all colors |

TABLE 8-continued

| Sample | Other dye sensitization based on emulsion (i) Sensitizing dye | Sensitivity maximum wavelength region | Proportion of emulsion | Color negative used | Tone varying filter used in combination with color CC filter and evaluation of print obtained B + C + E | No | A + D | Evaluation |
|---|---|---|---|---|---|---|---|---|
| (7) | — | — | — | Low contrast | ⊙ | Δ | x | Having a |
| The | SG-4 | 520 nm | 20% | Standard | Δ | ⊙ | Δ | broad tone |
| present | SR-11 | 700 nm | 20% | High contrast | x | Δ | ⊙ | variability |
| invention | | | | | | | | |

It can be seen from Table 8 that the sample (1) of the present invention can give prints which satisfy all points as black and white printing paper in printing using any color negatives differing in contrast by selecting the tone varying filters. Similarly, it can be seen that the sample (7) of the present invention can also give the similar prints to those obtained from the sample (1) by using the sensitizing dye having the sensitivity maximum at 520 nm utilizable for both the blue sensitive and green sensitive wavelength regions. On the other hand, the sample (2) has some tone variability, but is not sufficiently varied in tone since the proportion of the emulsion of toe characteristics necessary to form low contrast characteristics is great. The sample (3) which is outside the scope of the present invention cannot be varied in tone by using any tone varying filters. The sample (4) varies in the tone, but is not sufficient in width of tone reproduction because tone varying filters are not suitable for the dye sensitized emulsion and thus, suitable tone reproducing filters must be selected. The sample (5) has some tone variability, but since it does not have low contrast characteristics which are preferable for all of the blue, green and red sensitive wavelength regions, sufficient tone variation cannot be performed even when tone varying filters are used. The sample (6) which is outside the scope of the present invention does not have red sensitive low contrast emulsion component and therefore, does not have the width of tone reproduction applicable to color negatives.

EXAMPLE 8

Subsequently, tone varying filters were prepared by the method of Example 5 using the following dye adapted to the maximum wavelength of the dye sensitized emulsion used for the sample (4) in Example 7. Using these tone varying filters, the sample (4) was printed with the color negative in the same manner as in Example 7. The results obtained are shown in Table 9.

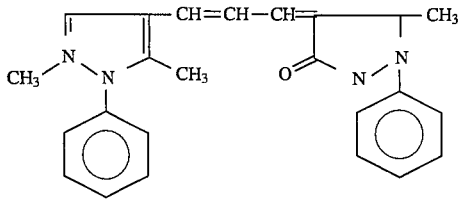

(F) 495 nm cutting dye

-continued

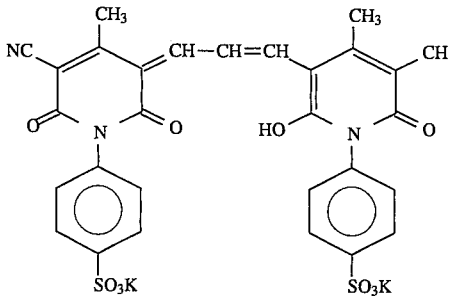

(G) 560 nm cutting dye

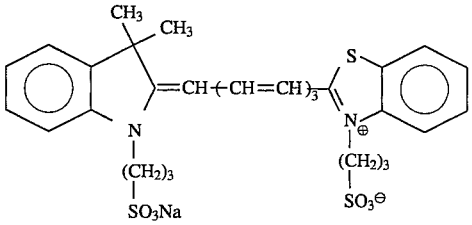

(H) 745 nm cutting dye

TABLE 9

| Sample | Other dye sensitization based on emulsion (i) | | | Color negative used | Tone varying filter used in combination with color CC filter and evaluation of print obtained | | | Evaluation |
|---|---|---|---|---|---|---|---|---|
| | Sensitizing dye | Sensitivity maximum wavelength region | Proportion of emulsion | | B + C + E | No | A + D | |
| (1) | SB-13 | 495 nm | 20% | Low contrast | o | Δ | x | Having a |
| The | SG-12 | 560 nm | 20% | Standard | Δ | o | Δ | broad tone |
| present | SR-5 | 740 nm | 20% | High contrast | x | Δ | o | variability |
| invention | | | | | | | | |

It can be seen that the sample (4) is improved in adaptability to the tone varying filter and thus, is further widened in applicability to color negatives differing in contrast than the sample (4) of Example 7 and prints satisfactory as black and white printing papers are obtained.

In this way, in the case of the conventional panchromatic printing papers, printing papers of different tone number must be assorted while in the case of the panchromatic printing papers of the present invention, one kind of the printing papers can be adapted to all color negatives by using tone varying filters.

What is claimed is:

1. A silver halide photographic photosensitive material comprising a support and one silver halide emulsion layer provided on the support wherein when γ (gamma) values of characteristic curves obtained by exposure through filters having a transmission maximum wavelength at about 430 nm, about 540 nm and about 700 nm are indicated by $\gamma_B$, $\gamma_G$ and $\gamma_R$, respectively, the following inequalities $0.3<\gamma_G/\gamma_B<0.7$ and $0.3<\gamma_G/\gamma_R<1.0$ are satisfied.

2. A method for the formation of a black and white image which comprises exposing the silver halide photographic photosensitive material of claim 1 from a color negative and subsequently carrying out a black and white development.

* * * * *